US006315279B1

(12) United States Patent
Minamishin et al.

(10) Patent No.: US 6,315,279 B1
(45) **Date of Patent: *Nov. 13, 2001**

(54) PAPER PROCESSING APPARATUS

(75) Inventors: Hayato Minamishin, Kawasaki; Yuji Tanaka, Kanagawa; Hayami Abe, Kawasaki, all of (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/354,100

(22) Filed: Jul. 15, 1999

(30) Foreign Application Priority Data

Jan. 7, 1999 (JP) ..... 11-001538

(51) Int. Cl.[7] ..... B65H 5/22; B65H 83/00; B65H 85/00; B65H 5/00; B65H 39/10

(52) U.S. Cl. ..... 271/3.15; 271/3.17; 271/10.02; 271/302

(58) Field of Search ..... 235/475, 476; 271/3.13, 3.17, 10.02, 3.15, 10.04, 298, 302, 303

(56) References Cited

U.S. PATENT DOCUMENTS

| | | | | |
|---|---|---|---|---|
| 4,166,945 | | 9/1979 | Inoyama et al. | 235/379 |
| 4,253,016 | * | 2/1981 | Hirose | 235/381 |
| 4,585,928 | * | 4/1986 | Watanabe | 235/379 X |
| 4,596,924 | * | 6/1986 | Watanabe | 235/379 X |
| 5,021,639 | * | 6/1991 | Hara et al. | 235/379 |
| 5,673,333 | * | 9/1997 | Johnston | 235/379 X |
| 5,683,079 | * | 11/1997 | Ebrahimi | 271/258.01 |
| 5,844,221 | * | 12/1998 | Madigan, Jr. et al. | 235/383 |
| 6,068,194 | * | 5/2000 | Mazur | 235/492 X |

FOREIGN PATENT DOCUMENTS

| | | |
|---|---|---|
| 60-7590 | 1/1985 | (JP) . |
| 62-2393 | 1/1987 | (JP) . |
| 1-265387 | 10/1989 | (JP) . |
| 8-221636 | 8/1996 | (JP) . |

* cited by examiner

*Primary Examiner*—Christopher P. Ellis
*Assistant Examiner*—Gene O. Crawford
(74) *Attorney, Agent, or Firm*—Armstrong, Westerman, Hattori, McLeland & Naughton, LLP

(57) ABSTRACT

A paper money processing apparatus has a money reception unit and a payment unit. The money reception unit has a conveyance passage for receiving paper moneys supplied from the exterior into a money receipt box, a receipt discriminator for discriminating paper moneys thus received, and conveyance passages. The payment unit has conveyance passages for conveying paper moneys stacked in stackers to the exterior, and a payment discriminator for discriminating paper moneys to be paid. The money reception unit and the payment unit are detachably coupled with one another.

3 Claims, 8 Drawing Sheets

PAPER PROCESSING APPARATUS

BACKGROUND OF THE INVENTION

1. Field of the Invention

The present invention relates to a paper processing apparatus for performing delivery and taking in for paper such as paper money and also performing discrimination of paper.

2. Description of the Related Art

As a kind of the above-mentioned paper processing apparatus, hitherto, there is known an automatic teller machine (hereinafter referred to as "ATM"), which is set up at banks and other financial institution, for performing transactions such as receipt of money and payment in paper money. Such an ATM has, usually, an ability of carrying out both the transactions of receipt of money and payment.

On the other hand, a business form of banks or the like and an environment for set up of an ATM are not unitary. Thus, in some case, it would be desirable that an ATM performs both the transactions of receipt of money and payment. Alternatively, in another case, it would be desired that an ATM performs transactions of payment only. As a measure to reply to these requirements, hitherto, there is known such a measure that a receipt and payment type of ATM having an ability of carrying out both the transactions of receipt of money and payment is supplied, and the receipt and payment type-of ATM is optionally utilized as an ATM performing both the transactions of receipt of money and payment or as a payment-dedicated ATM for performing transactions of payment only. Alternatively, there is known such a measure that a receipt and payment type of ATM having an ability of carrying out both the transactions of receipt of money and payment, and in addition a payment-dedicated ATM for performing transactions of only payment.

However, such a receipt and payment type of ATM had needs a high cost for implementing an ability of carrying out the transactions of receipt of money, and thus it is useless in cost that such a receipt and payment type of ATM is used for the payment transactions only.

Further, usually, in order to avoid the above-mentioned uselessness, a payment-dedicated ATM has a structure greatly different from that of a receipt and payment type of ATM. Consequently, although a common function of performing transactions of payment is implemented, a technology accumulated in a development for a payment-dedicated ATM is different from a technology accumulated in a development for a receipt and payment type of ATM, and thus it is difficult to apply these technologies to one another. Therefore, in order to supply both the receipt and payment type of ATM and the payment-dedicated ATM, a development cost is doubly needed.

The above-mentioned problems are associated with not only an ATM dealing with paper money, generally but also a paper processing apparatus for performing delivery and receiving for paper.

SUMMARY OF THE INVENTION

In view of the foregoing, it is an object of the present invention to provide a paper processing apparatus of low cost.

To achieve the above-mentioned objects, the present invention provides a paper processing unit comprising:

a delivery unit comprising a shed for receiving paper moneys, a delivery mechanism for delivering paper moneys from said shed to an exterior, and a first paper discriminator for discriminating paper moneys to be delivered by said delivery mechanism to the exterior;

a receipt unit comprising a receipt mechanism for receiving paper moneys inserted from the exterior, a second paper discriminator for discriminating the paper moneys received by said receipt mechanism, and a conveyance mechanism for conveying the paper moneys discriminated by said second paper discriminator to said delivery unit; and a control unit for controlling said delivery unit and said receipt unit, wherein said delivery unit and said receipt unit are detachably coupled to one another.

According to the paper processing apparatus, the delivery unit and the receipt unit are detachably coupled to one another. Thus, a user, who demands only the function of a delivery of paper, can obtain only the 5 delivery unit and use it as a delivery-dedicated paper processing apparatus, and thereby obtaining an inexpensive paper processing apparatus. Further, the delivery unit of the paper processing apparatus effecting both the functions of delivery and reception can be applied to a delivery-dedicated paper processing apparatus as it is. Thus, it is possible to reduce the cost of the paper processing apparatus in development.

In the paper processing apparatus of the present invention as mentioned above, it is preferable that said delivery unit has a backflow preventer for preventing paper moneys from flowing backward from said delivery unit to said receipt unit.

A provision of such a backflow preventer makes it possible to avoid such trouble that paper of the delivery unit gets mixed into said receipt unit.

In the paper processing apparatus of the present invention as mentioned above, it is preferable that said receipt unit has a temporal shed for temporarily receiving the paper moneys discriminated by said second paper discriminator, and said conveyance mechanism conveys the paper moneys received in said temporal shed to said delivery unit.

According to the above-mentioned paper processing apparatus, in the event that paper is received into the receiving unit once and thereafter it is required to return the paper, the paper received in the temporal shed is returned. Thus, it is possible to return the received paper as it is. A provision of the temporal shed on the reception unit makes it possible to supply the inexpensive paper processing apparatus in the event that the delivery unit is provided as a delivery-dedicated paper processing apparatus.

Further, in the paper processing apparatus of the present invention as mentioned above, it is preferable that said delivery unit is detachably coupled with any of a plurality of sorts of the receipt unit, and said control unit performs a control according to the receipt unit coupled with said delivery unit.

As a receiving form of paper according to a paper processing apparatus, it happens that a various types of receiving form of paper are required in accordance with an environment of set up of the paper processing apparatus.

According to the paper processing apparatus of the present invention, there is provided a control unit for performing a control according to the receipt unit coupled with the delivery unit. This feature makes it possible to apply a single type of delivery unit to a plurality of sorts of the receipt unit corresponding to the various types of receiving form of paper. Thus, it is possible to reduce the cost for a development to implement a various types of receiving form of paper.

DETAILED DESCRIPTION OF PREFERRED EMBODIMENTS

Hereinafter, there will be described a paper processing apparatus according to embodiments of the present invention.

Embodiments of the present invention relate to a kind of ATM. In such an ATM, there exist four types of money receipt units corresponding to the receipt unit referred to in the present invention. These four types of money receipt units are exchangeable, and are mutually different in a receiving form for money. In order to distinguish those four types of money receipt units from one another, those four types are referred to as "standard type", "simple type", "very simple type", and "back-receipt type", respectively.

Figure 1:
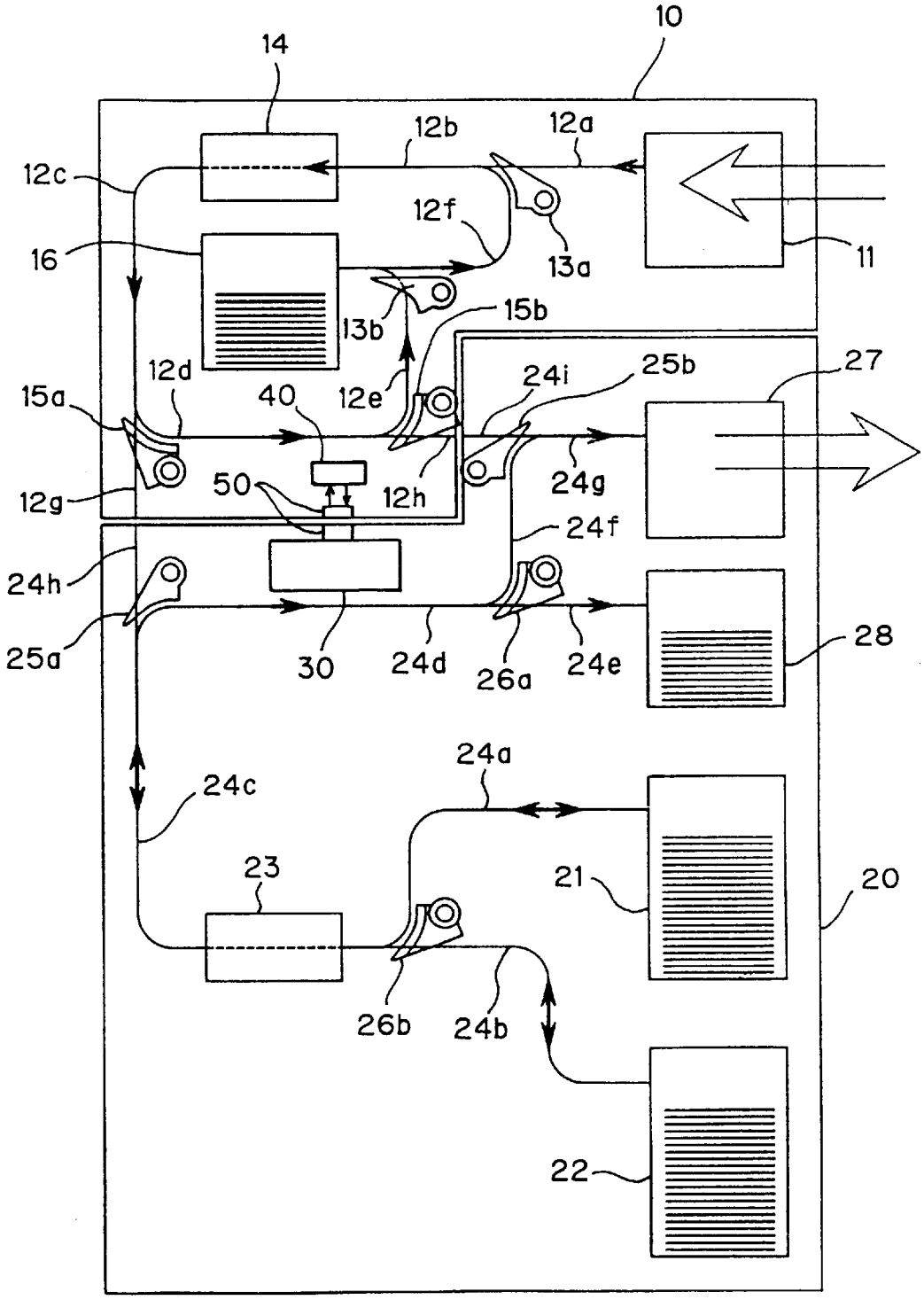
FIG. 1 is a conceptual sectional view showing a case where a "standard type" of money receipt unit is used in accordance with an embodiment of the present invention.
Figure 2:
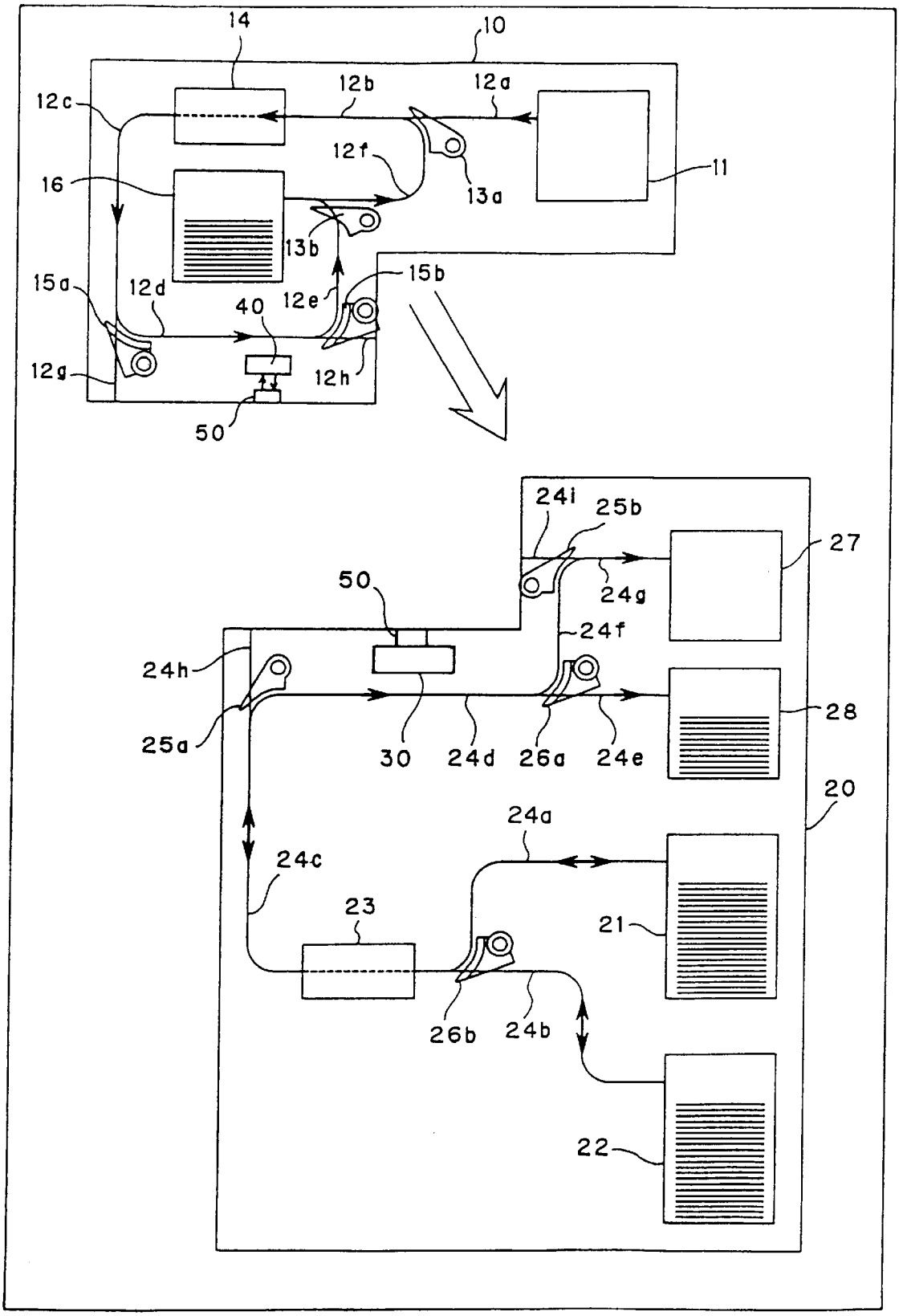
FIG. 2 is a view showing a state that a "standard type" of money receipt unit and a payment unit corresponding to the delivery unit referred to in the present invention are separated from one another.

FIG. 1 is a conceptual sectional view showing a case where a "standard type" of money receipt unit is used in accordance with an embodiment of the present invention. FIG. 2 is a view showing a state that a "standard type" of money receipt unit and a payment unit corresponding to the delivery unit referred to in the present invention are separated from one another. In the following explanation, FIG. 1 and FIG. 2 are not distinguished from one another, unless it is particularly noted.

According to the present-embodiment, a user, who utilizes an ATM to perform transactions for receipt and payment, accesses the ATM from the right with respect to the figures. That is, the right of the figures is a "front" of the ATM, and the left of the figures is a "back" of the ATM.

In the upper portion of the figures, there is illustrated a "standard type" of money reception unit 10. Below the money reception unit 10, there is illustrated a payment unit 20 corresponding to the delivery unit referred to in the present invention. The money reception unit 10 and the payment unit 20 are detachably coupled with each other. FIG. 1 shows a state that the of money reception unit 10 and the payment unit 20 are coupled with each other. FIG. 2 shows a state that the money reception unit 10 and the payment unit 20 are separated from one another. In these figures, there are omitted in illustration a jig and the like for fixing the money reception unit 10 and the payment unit 20 to one another.

According to the present embodiment, the payment unit 20 is used as a main frame, and in some case, the payment unit 20 may be used solely. That is, for a bank and the like who requires an ATM to perform payment transactions only, there is provided only the payment unit 20. Thus, it is possible to meet the demand, and in addition to provide an inexpensive ATM since the money reception unit 10 can be omitted.

Further, according to the present embodiment, the above-mentioned four types of money receipt units may be used as an attachment component which is detachable with respect to the payment unit 20, and are used only in a state that they are coupled with the payment unit 20. Furthermore, according to the present embodiment, the payment unit 20 is provided with a control unit 30 for controlling the respective operations, which will be described later, for the above-mentioned four types of money receipt units and the payment unit 20. A provision of such a control unit 30 makes it possible to optionally mount the above-mentioned four types of money receipt units on one sort of payment unit 20. Thus, to develop four types of money receipt units, it is possible to apply one sort of payment unit 20, thereby implementing low cost for the development. The control unit 30 receives a predetermined instruction from an exterior via an input unit (not illustrated) and perform a control according to the instruction.

The payment unit 20 comprises stackers 21 and 22 for stacking paper moneys for each sort of money, respectively, which are examples of a shed referred to in the present invention, a payment discriminator 23 for discriminating paper moneys to be paid, which is an example of the second paper discriminator referred to in the present invention, and conveyance passages 24*a*, 24*b*, 24*c*, 4*d*, 24*e*, 24*f*, 24*g*, 24*h* and 24*i* for conveying paper moneys. In the event that payment transactions are performed, paper moneys corresponding to the payment amount, of the paper moneys stacked in the stackers 21 and 22, are conveyed through the conveyance passages 24*a* and 24*b* to a payment discriminator 23 so as to be discriminated by the payment discriminator 23. The paper moneys stacked in the stackers 21 and 22 are paper moneys verified in the point that those are fair paper moneys. Thus, the payment discriminator 23 performs a simple discrimination on a verification basis. Discriminated paper moneys are conveyed through the conveyance passage 24*c*.

The payment unit 20 is provided with a one-way gate 25*a* for preventing paper moneys from getting mixed from the conveyance passages 24*c* and 24*d* to the conveyance passage 24*h*, the one-way gate 25*a* being an example of the backflow preventer referred to in the present invention. The one-way gate 25*a* is enabled by a spring force to interrupt the conveyance passage 24*h*. A paper money conveyed to the one-way gate 25*a* through the conveyance passage 24*c* is transferred to the conveyance passage 24*d* by the one-way gate 25*a* so as to be conveyed through the conveyance passage 24*d*. In this manner, a provision of the one-way gate 25*a* makes it possible to prevent the paper money from getting mixed into the money reception unit 10. In the event that the money reception unit 10 is separated, it is possible to prevent a paper money from flowing backward through the conveyance passage 24*h* to go out of the ATM.

Further, the payment unit 20 is provided with a distribution gate 26*a* for distributing a paper money conveyed through the conveyance passage 24*d* to the distribution gate 26*a* to the conveyance passage 24*e* or the conveyance passage 24*f* in accordance with a discrimination result by the payment discriminator 23. When the payment discriminator 23 discriminates a paper money as a "true note", the paper money is distributed to the conveyance passage 24*f*. On the other hand, when the payment discriminator 23 discriminates a paper money as a "counterfeit note", the paper money is distributed to the conveyance passage 24*e*.

Furthermore, the payment unit 20 is provided with a payment box 27, a reject box 28 and a one-way gate 25*b*, similar to the above-mentioned one-way gate 25*a*, for preventing paper moneys from getting mixed from the conveyance passages 24*f* and 24*g* to the conveyance passage 24*i*, the one-way gate 25*b* being an example of the backflow preventer referred to in the present invention. The paper money distributed to the conveyance passage 24*f* by the distribution gate 26*a* is conveyed through the conveyance passages 24*f* and 24*g* via the one-way gate 25*b* to the payment box 27 to be stored therein. Thus, the paper money is delivered to the front of the ATM. Hence, the abovementioned conveyance passages 24*a*, 24*b*, 24*c*, 24*d*, 24*f* and 24*g*, the distribution gate 26*a*, and the payment box 27 constitute an example of the delivery mechanism referred to in the present invention. On the other hand, the paper money distributed to the conveyance passage 24*e* by the distribution gate 26*a* is conveyed through the conveyance passage 24*e* to the reject box 28 to be stored therein. Thereafter, the paper moneys thus stored are collected by a bank or the like.

The "standard type" of money reception unit 10 is provided with a signal generator 40 for generating a recognition signal indicating that the money reception unit 10 is of a "standard type". The money reception unit 10 and the payment unit 20 have first and second connectors 50, respectively, which are connected to one another when the money reception unit 10 and the payment unit 20 are coupled with each other. When the money reception unit 10 and the payment unit 20 are coupled with each other, a demand signal requesting the recognition signal is transmitted from the control unit 30 via the first and second connectors 50 to the signal generator 40. Upon receipt of demand signal, the signal generator 40 generates the recognition signal, and the control unit 30 receives the recognition signal. As a result, the control unit 30 recognizes that the money reception unit 10 is of a "standard type", so that the control unit 30 performs a control for a "standard type". As a result of a control for a "standard type", the money reception unit 10 makes a performance as set forth below.

A performance of the money reception unit 10 is divided broadly into three categories of a receipt operation for receiving paper moneys from the out of an ATM, a transfer operation for transferring paper moneys received from the exterior to the payment unit, and a return operation for returning paper moneys received from the exterior to the exterior. The receipt operation is executed when paper money is supplied from the out of an ATM to a money receipt box 11. The transfer operation and the return operation are selectively executed in accordance with an instruction of the exterior.

First, there will be described the receipt operation in conjunction with the structure of the money reception unit 10.

The money reception unit 10 is provided with conveyance passages 12*a*, 12*b*, 12*c*, 12*d*, 12*e*, 12*f*, 12*g* and 12*h* for conveying paper moneys. A paper money supplied to the money receipt box 11 is received through the conveyance passage 12*a* into the ATM and is conveyed. Accordingly, the money receipt box 11 and the conveyance passage 12*a* constitute the receipt mechanism referred to in the present invention. Further, the money reception unit 10 is provided with a one-way gate 13*a* for preventing paper moneys from going toward the conveyance passage 12*a* from the conveyance passages 12*b* and 12*f*, the one-way gate 13*a* being enabled to interrupt the conveyance passage 12*a*, and a receipt discriminator 14 for discriminating paper moneys supplied from the exterior, which is an example of the first paper discriminator referred to in the present invention. Paper moneys received into the ATM through the conveyance passage 12*a* are conveyed from the conveyance passage 12*a* to the conveyance passage 12*b* in such a manner that the money reception unit 10 is pushed aside, and then are transferred through the conveyance passage 12*b* to the receipt discriminator 14 so as to be discriminated. There is a possibility that paper moneys supplied from the exterior are counterfeit notes. In view of this, the receipt discriminator 14 performs more strictly the discrimination as compared with the payment discriminator 23. Paper moneys after the discrimination are conveyed through the conveyance passage 12*c*.

Further, the money reception unit 10 is provided with a distribution gate 15*a* for distributing a paper money conveyed through the conveyance passage 12*c* to the distribution gate 15*a* to the conveyance passage 12*d* or the conveyance passage 12*g* in accordance with the distribution gate 15*a*. At the time of a receipt operation, a paper money is distributed to the conveyance passage 12*d* by the distribution gate 15*a* and is conveyed through the conveyance passage 12*d*.

Further, the money reception unit 10 is provided with a distribution gate 15*b* for distributing a paper money conveyed through the conveyance passage 12*d* to the conveyance passage 12*e* or the conveyance passage 12*h*. At the time of a receipt operation, a paper money is distributed in accordance with a discrimination result by the receipt discriminator 14. When the receipt discriminator 14 discriminates a paper money as a "true note", the paper money is distributed to the conveyance passage 24*e*. On the other hand, when the receipt discriminator 14 discriminates a paper money as a "counterfeit note", the paper money is distributed to the conveyance passage 24*h*. The money reception unit 10 is provided with a temporal shed 16 for temporarily storing paper moneys supplied from the exterior and a one-way gate 13*b* being enabled to interrupt the conveyance passage 24*e*. Paper moneys distributed to the conveyance passage 24*e* by the distribution gate 15*b* are conveyed in such a manner that the one-way gate 13*b* is pushed aside, and then are stored in the temporal shed 16. On the other hand, paper moneys distributed to the conveyance passage 24*h* by the distribution gate 15*b* are conveyed through the conveyance passage 24*h*, which is an example of the conveyance mechanism referred to in the present invention, to the payment unit 20. The paper moneys conveyed to the payment unit 20 is conveyed through the conveyance passage 24*i* in such a manner that the one-way gate 25*b* is pushed aside, and then are conveyed through the conveyance passage 24*g* to the payment box 27 to be stored therein so that the paper moneys are returned out of the ATM.

Next, there will be described the transfer operation.

Paper moneys, which are supplied from the exterior in accordance with the above-mentioned receipt operation and stored in the temporal shed 16, are conveyed through the conveyance passages 12*f* and 12*b*, passing through the receipt discriminator 14, to the distribution gate 15*a* through the conveyance passage 12*c*. At the time of the transfer operation, the distribution gate 15*a* distributes paper moneys to the conveyance passage 12*g*. The paper moneys thus distributed are conveyed through the conveyance passage 12*g* to the payment unit 20. That is, the conveyance passages

12*f*, 12*b*, 12*c*, and 12*g* constitute an example of the conveyance mechanism referred to in the present invention. The paper moneys conveyed to the payment unit 20 is conveyed through the conveyance passage 24*h* in such a manner that the one-way gate 25*a* is pushed aside, and then are conveyed through the conveyance passage 24*c* and passes through the payment discriminator 23. The payment unit 20 is further provided with a distribution gate 26*b* for distributing paper moneys passed through the payment discriminator 23 to the conveyance passage 24*a* or the conveyance passage 24*b* in accordance with a sort of paper moneys. Paper moneys distributed to the conveyance passage 24*a* or the conveyance passage 24*a* are conveyed through the conveyance passage 24*a* or the conveyance passage 24*a* and are stored in the stackers 21 and 22, respectively.

Lastly, there will be described the return operation.

In a similar fashion to that of the above-mentioned transfer operation, according to the return operation, paper moneys, which are stored in the temporal shed 16, are conveyed through the conveyance passages 12*f* and 12*b*, passing through the receipt discriminator 14, to the distribution gate 15*a* through the conveyance passage 12*c*. At the time of the return operation, the distribution gate 15*a* distributes paper moneys to the conveyance passage 12*d*. The paper moneys thus distributed are conveyed through the conveyance passage 12*d* to the distribution gate 15*b*. At the time of the return operation, the distribution gate 15*b* distributes paper moneys to the conveyance passage 12*h*. The paper moneys thus distributed are conveyed through the conveyance passage 12*h* to the payment unit 20. Consequently, the conveyance passages 12*f*, 12*b*, 12*c*, 12*d* and 12*h* constitute an example of the conveyance mechanism referred to in the present invention. The paper moneys conveyed to the payment unit 20 is conveyed through the conveyance passage 24*i* in such a manner that the one-way gate 25*b* is pushed aside, and then are conveyed through the conveyance passage 24*g* to the payment box 27 to be stored therein. Thus, the paper moneys stored in the payment box 27 are returned out of the ATM. In this manner, it is possible to return to the outside the paper moneys stored in the temporal shed 16 in a state that those are distinguished from paper moneys stored in the stackers 21 and 22. Thus, in the event that a user of the ATM requires to return the paper moneys, paper moneys, which are supplied to the ATM by the user, may be returned to the user. Thus, it is possible to avoid the useless trouble, for example, in such a case where the user doubts the account.

Here, the description as to the use of the "standard type" of money receipt unit is terminated. Next, there will be described cases that the "simple type" of money receipt unit, the "very simple type" of money receipt unit and the "back-receipt type" of money receipt unit are used, respectively. However, as mentioned above, with respect to the payment unit and the control unit, those units are the same as those in the event that the "standard type" of money receipt unit is used. Thus, the redundant description will be omitted. Further, also with respect to the operation after the conveyance of paper moneys to the payment unit, the redundant description will be omitted.

In FIGS. 3 to 8, similar to FIGS. 1 and 2, the right of the figures is a "front" of the ATM, and the left of the figures is a "back" of the ATM.

Figure 3:
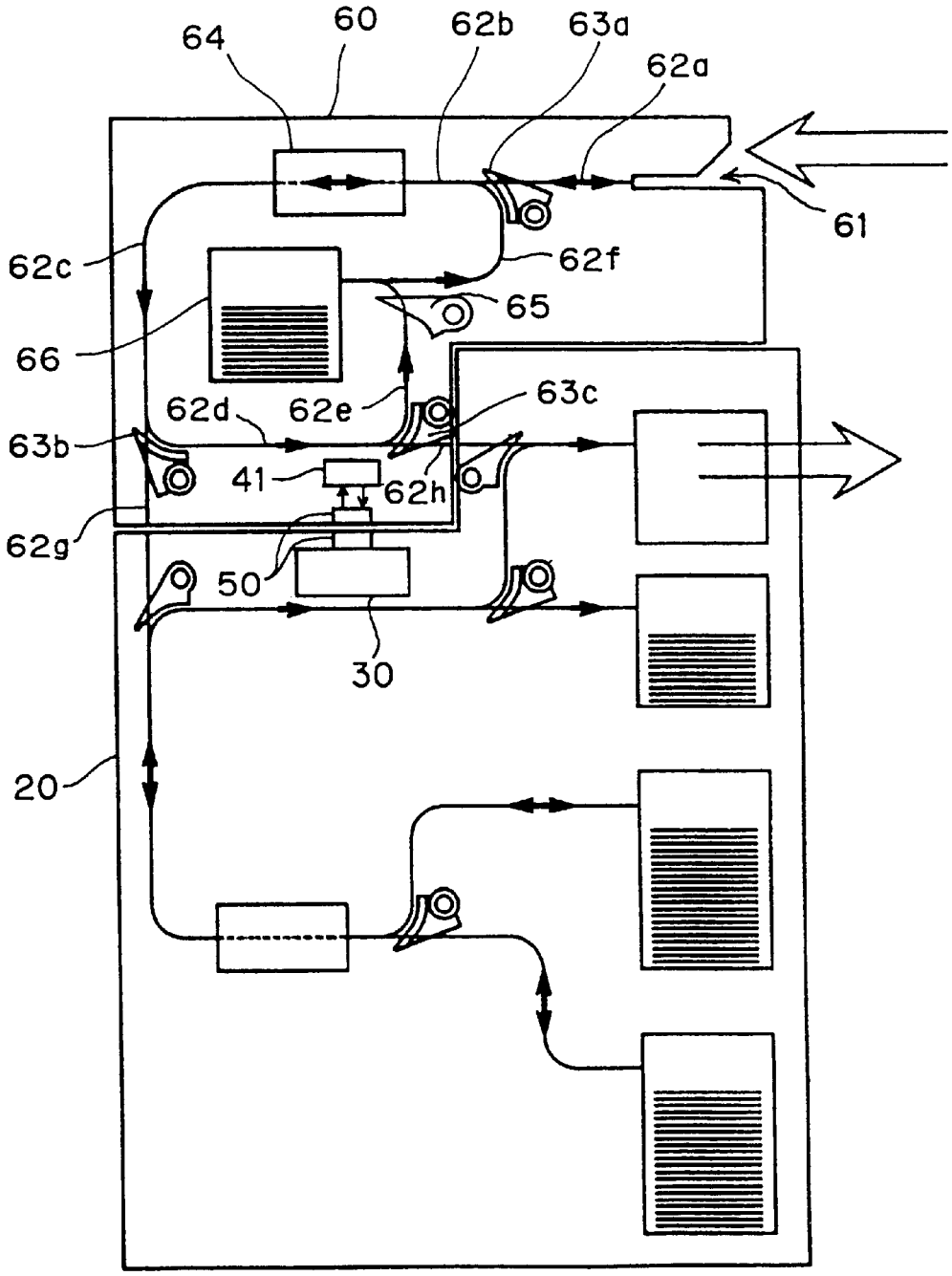
FIG. 3 is a conceptual sectional view showing a case where a "simple type" of money receipt unit is used in accordance with an embodiment of the present invention.
Figure 4:
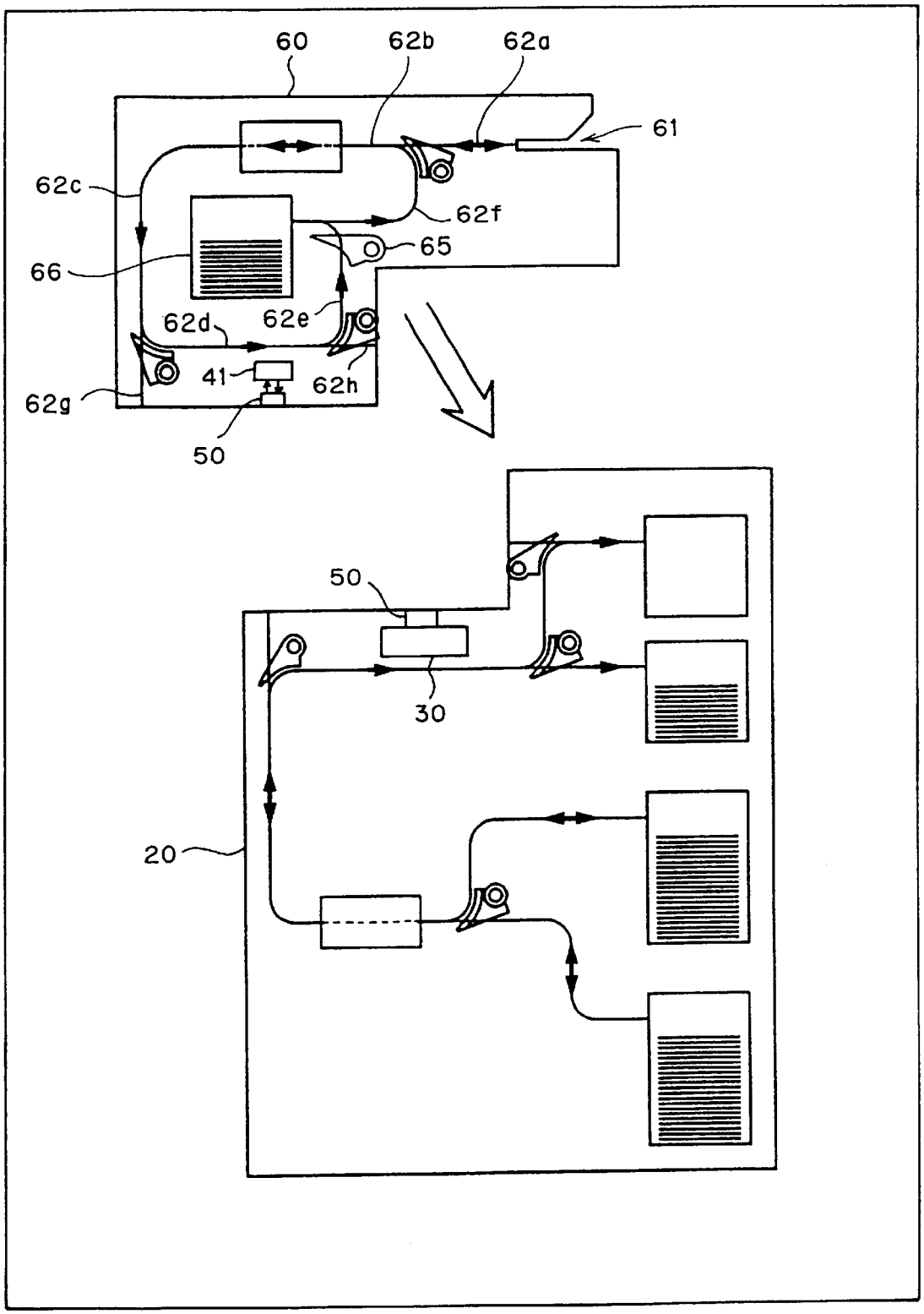
FIG. 4 is a view showing a state that a "simple type" of money receipt unit and a payment unit are separated from one another.

FIG. 3 is a conceptual sectional view showing a case where a "simple type" of money receipt unit is used in accordance with an embodiment of the present invention. FIG. 4 is a view showing a state that a "simple type" of money receipt unit and a payment unit are separated from one another. In the following explanation, FIG. 3 and FIG. 4 are not distinguished from one another, unless it is particularly noted.

In the upper portion of the figures, there is illustrated a "simple type" of money reception unit 60. The "simple type" of money reception unit 60 is provided with a signal generator 41 for generating a recognition signal indicating that the money reception unit 60 is of a "simple type". The money reception unit 60 is also provided with a connector 50. When the money reception unit 60 and the payment unit 20 are coupled with each other, the control unit 30 recognizes that the money reception unit 60 is of a "simple type", so that the control unit 30 performs a control for a "simple type". As a result of a control for a "simple type", the money reception unit 60 makes a performance as set forth below.

A performance of the "simple type" of money reception unit 60 is divided broadly, in a similar fashion to that of the "standard type" of money receipt unit, into three categories of the receipt operation, the transfer operation, and the return operation.

First, there will be described the receipt operation in conjunction with the structure of the money reception unit 60.

In the front of the money reception unit 60, there is provided an insertion aperture 61 into which paper moneys are inserted one by one from the exterior. The money reception unit 60 is provided with conveyance passages 62*a*, 62*b*, 62*c*, 62*d*, 62*e*, 62*f*, 62*g* and 62*h* for conveying paper moneys. A paper money inserted through the insertion aperture 61 is received through the conveyance passage 62*a* into the money receipt unit 60 and is conveyed. Accordingly, the insertion aperture 61 and the conveyance passage 62*a* constitute an example of the receipt mechanism referred to in the present invention. According to the present embodiment, since paper moneys are received from the exterior one by one, the receiving speed for paper moneys is extremely slower than that of the money reception unit 60.

Further, the money reception unit 60 is provided with a distribution gate 63*a* and a receipt discriminator 64, which is an example of the first paper discriminator referred to in the present invention. Paper moneys received through the conveyance passage 62*a* are conveyed through the conveyance passages 62*a* and 62*b* via the distribution gate 63*a* to the receipt discriminator 64 so as to be discriminated. Since the speed of receiving paper moneys through the conveyance passage 62*a* is slow, as the receipt discriminator 64, there is used a simple receipt discriminator which is slow in a discrimination speed. When the receipt discriminator 64 discriminates a paper money as a "counterfeit note", the paper money is returned through the conveyance passage 62*b* to the front of the ATM, and is distributed by the distribution gate 63*a* to the conveyance passage 62*a* so that the paper money is discharged from the insertion aperture 61 through the conveyance passage 62*a* out of the ATM. When the receipt discriminator 64 discriminates a paper money as a "true note", the paper money is conveyed through the conveyance passage 62*c*.

Further, the money reception unit 60 is provided with a distribution gate 63*b* for distributing, at the time of a receipt operation, a paper money conveyed through the conveyance passage 62*c* to the conveyance passage 62*d*. Furthermore, the money reception unit 60 is provided with a distribution gate 63*c* for distributing, at the time of the receipt operation, the paper money conveyed through the conveyance passage 62*d* to the conveyance passage 62*e*.

The money reception unit 60 is provided with a one-way gate 65 being enabled to interrupt the conveyance passage 62*e*, and a temporal shed 66 for temporarily storing paper moneys. Paper moneys distributed to the conveyance passage 62*e* by the distribution gate 63*c* are conveyed through the conveyance passage 62*e* to the temporal shed 66 in such a manner that the one-way gate 65 is pushed aside, and then are stored in the temporal shed 66.

Next, there will be described the transfer operation.

This transfer operation is completely the same as that of the "standard type" of money reception unit 10 shown in FIG. 1. That is, paper moneys, which are stored in the temporal shed 66, are conveyed through the conveyance passages 62*f* and 62*b*, passing through the receipt discriminator 64, to the distribution gate 63*b* through the conveyance passage 62*c*. The distribution gate 63*b* distributes paper moneys to the conveyance passages 62*g*. The paper moneys thus distributed are conveyed through the conveyance passage 62*g* to the payment unit 20. That is, the conveyance passages 62*f*, 62*b*, 62*c*, and 62*g* constitute an example of the conveyance mechanism referred to in the present invention.

Lastly, there will be described the return operation.

This return operation is completely same as that of the "standard type" of money reception unit 10 shown in FIG. 1. That is, paper moneys, which are stored in the temporal shed 66, are conveyed through the conveyance passages 62*f* and 62*b*, passing through the receipt discriminator 64, to the distribution gate 63*b* through the conveyance passage 62*c*. The distribution gate 63*b* distributes paper moneys to the conveyance passage 62*d*. The paper moneys thus distributed are conveyed through the conveyance passage 62*d* to the distribution gate 63*c*, and are distributed to the conveyance passage 62*h* by the distribution gate 63*c*. The paper moneys thus distributed are conveyed through the conveyance passages 62*h* to the payment unit 20. Consequently, the conveyance passages 62*f*, 62*b*, 62*c*, 62*d* and 62*h* constitute an example of the conveyance mechanism referred to-in the present invention.

Figure 5:
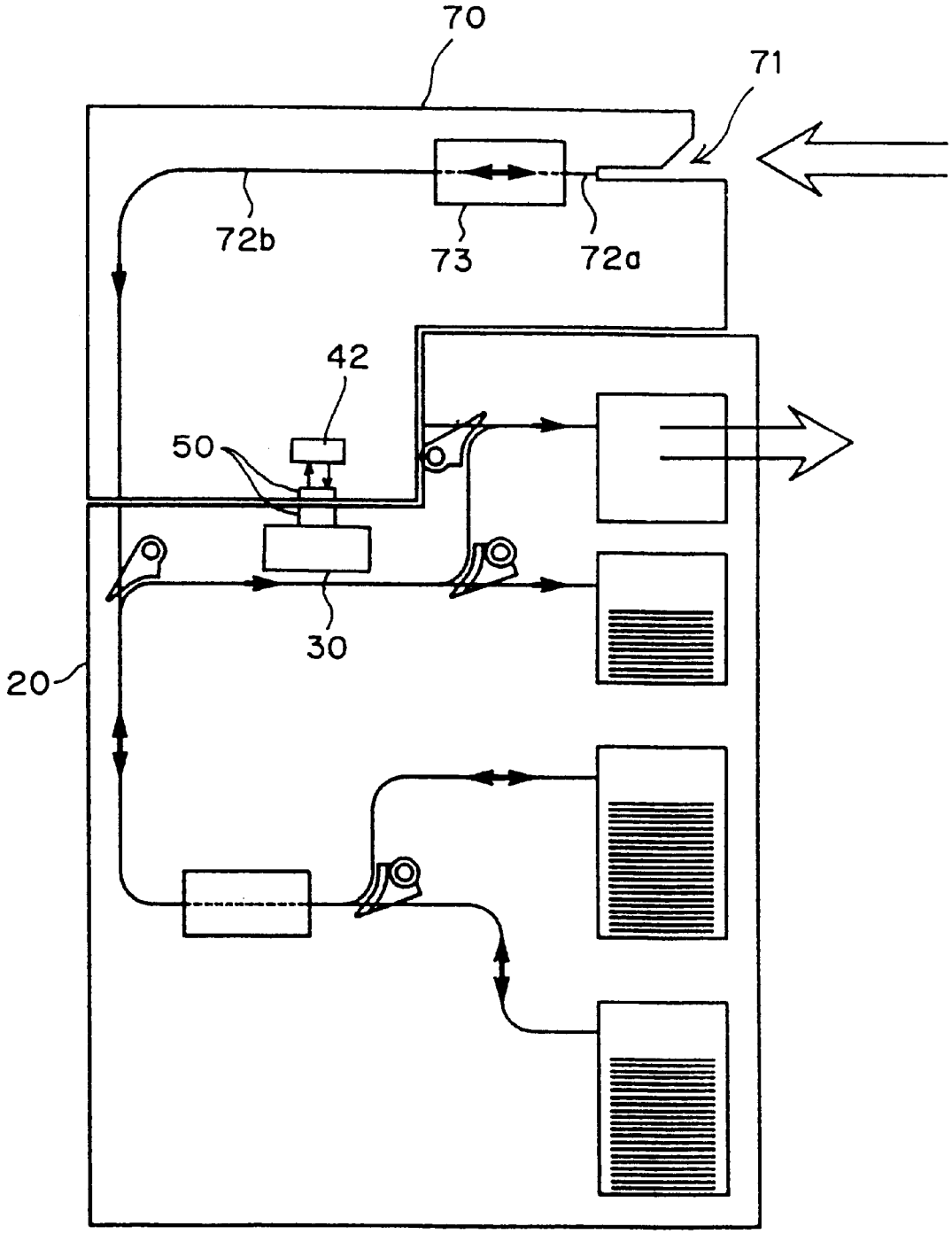
FIG. 5 is a conceptual sectional view showing a case where a "very simple type" of money receipt unit is used in accordance with an embodiment of the present invention.
Figure 6:
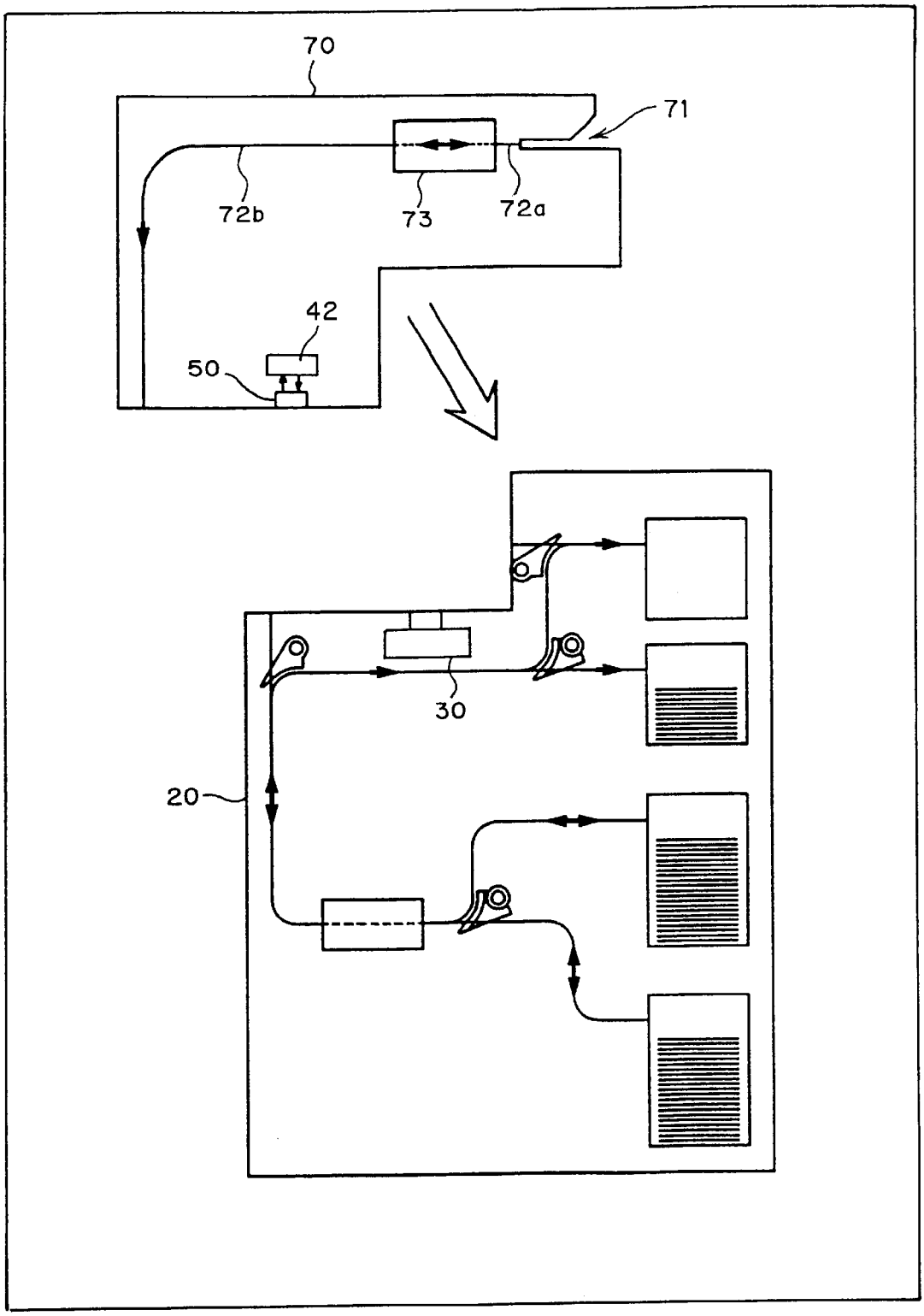
FIG. 6 is a view showing a state that a "very simple type" of money receipt unit and a payment unit are separated from one another.

FIG. 5 is a conceptual sectional view showing a case where a "very simple type" of money receipt unit is used in accordance with an embodiment of the present invention. FIG. 6 is a view showing a state that a "very simple type" of money receipt unit and a payment unit are separated from one another. In the following explanation, FIG. 5 and FIG. 6 are not distinguished from one another, unless it is particularly noted.

In the upper portion of the figures, there is illustrated a "very simple type" of money reception unit 70. The "very simple type" of money reception unit 70 is provided with a signal generator 42 for generating a recognition signal indicating that the money reception unit 70 is of a "very simple type". The money reception unit 70 is also provided a connector 50. When the money reception unit 70 and the payment unit 20 are coupled with each other, the control unit 30 recognizes that the money reception unit 70 is of a "very simple type", so that the control unit 30 performs a control for a "very simple type". As a result of a control for a "very simple type", the money reception unit 70 makes a performance as set forth below.

In the front of the "very simple type" of money reception unit 70, there is provided an insertion aperture 71 which is similar to the insertion aperture 61. The money reception unit 70 is provided with conveyance passages 72*a* and 72*b* for conveying paper moneys, and a receipt discriminator 73, which is an example of the first paper discriminator referred to in the present invention. The receipt discriminator 73 is similar to the receipt discriminator 64 shown in FIG. 3. A paper money inserted through the insertion aperture 71 is received through the conveyance passage 72*a* into the ATM. Accordingly, the insertion aperture 71 and the conveyance passage 72*a* constitute an example of the receipt mechanism referred to in the present invention. Paper moneys received into the ATM are conveyed through the conveyance passage 72*a* to the receipt discriminator 73 so as to be discriminated. When the receipt discriminator 73 discriminates a paper money as a "counterfeit note", the paper money is returned through the conveyance passage 72*a* to the insertion aperture 71 so that the paper money is discharged from the insertion aperture 71 out of the ATM. When the receipt discriminator 73 discriminates a paper money as a "true note", the paper money is conveyed through the conveyance passage 72*b* to the payment unit 20. Accordingly, the conveyance passage 72*b* is an example of the conveyance mechanism referred to in the present invention.

Figure 7:
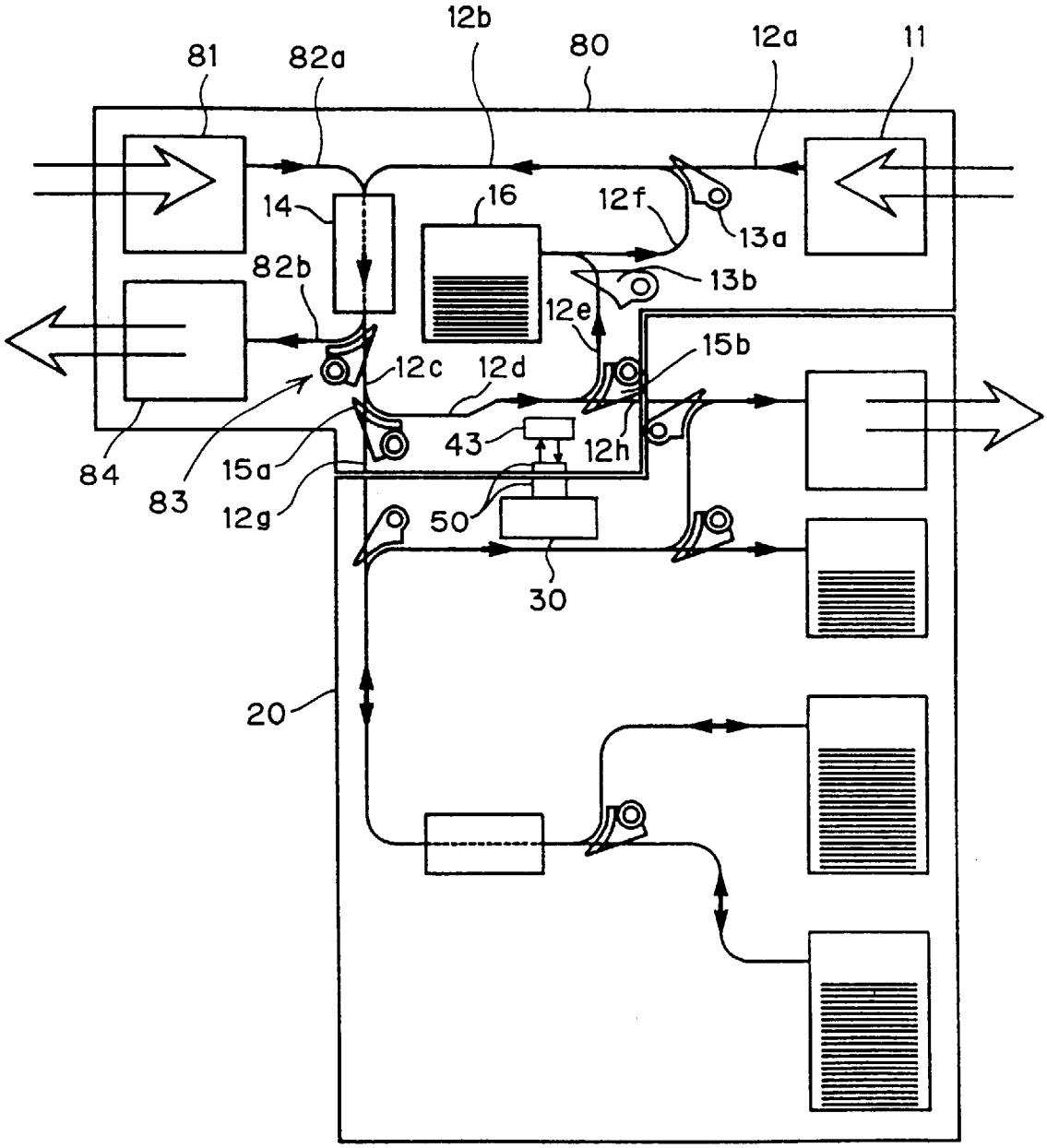
FIG. 7 is a conceptual sectional view showing a case where a "back-receipt type" of money receipt unit is used in accordance with an embodiment of the present invention.
Figure 8:
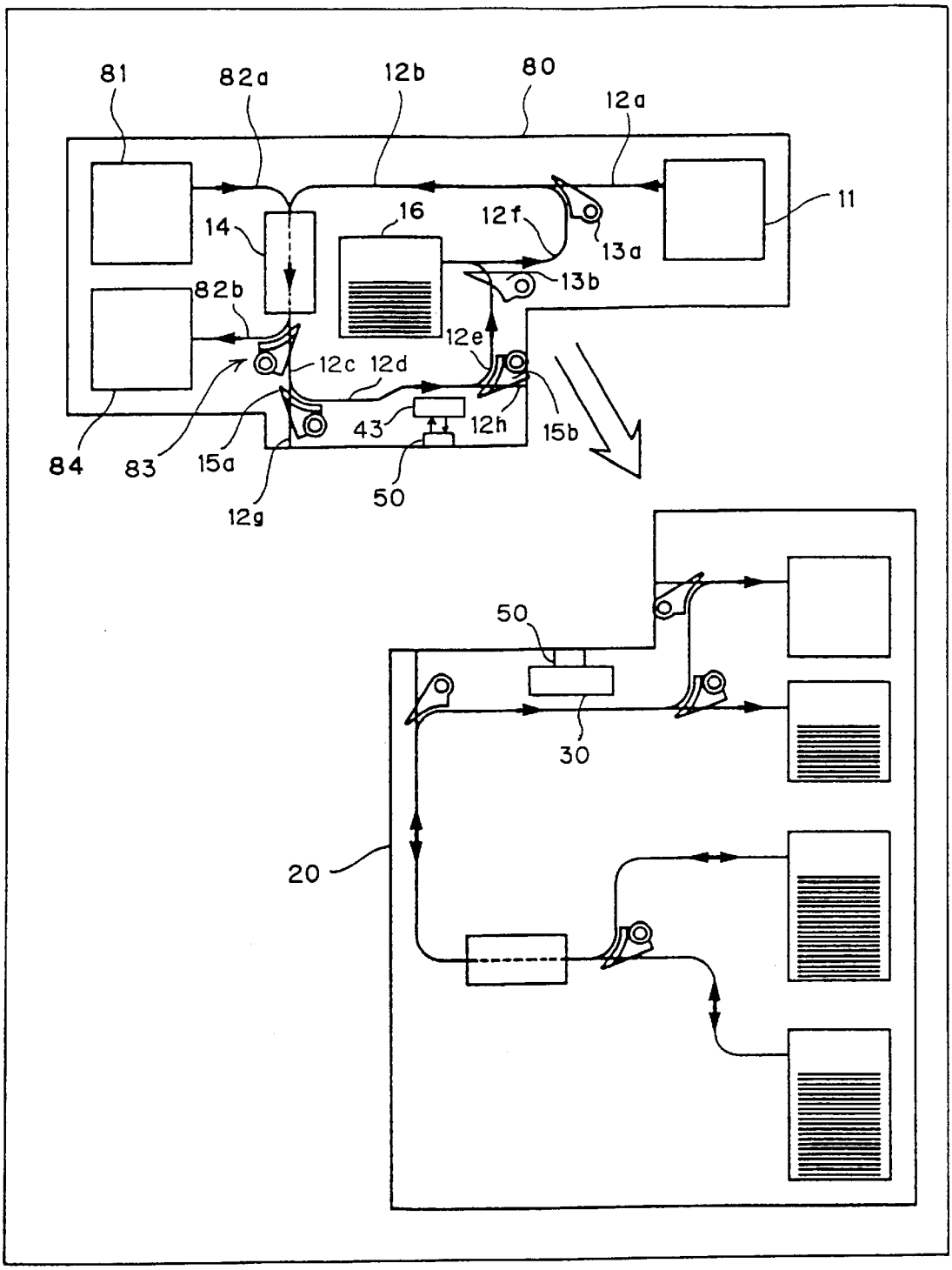
FIG. 8 is a view showing a state that a "back-receipt type" of money receipt unit and a payment unit are separated from one another.

FIG. 7 is a conceptual sectional view showing a case where a "back-receipt type" of money receipt unit is used in accordance with an embodiment of the present invention. FIG. 8 is a view showing a state that a "back-receipt type" of money receipt unit and a payment unit are separated from one another. In the following explanation, FIG. 7 and FIG. 8 are not distinguished from one another, unless it is particularly noted.

In the upper portion of the figures, there is illustrated a "back-receipt type" of money reception unit 80. The "back-receipt type" of money reception unit 80 is provided with a signal generator 43 for generating a recognition signal indicating that the money reception unit 80 is of a "back-receipt type". The money reception unit 80 is also provided with a connector 50. When the money reception unit 80 and the payment unit 20 are coupled with each other, the control unit 30 recognizes that the money reception unit 80 is of a "back-receipt type", so that the control unit 30 performs a control for a "back-receipt type". As a result of a control for a "back-receipt type", the money reception unit 80 makes a performance as set forth below.

Hereinafter, there will be described the money reception unit 80. In FIGS. 7 and 8, the same parts are denoted by the same reference numbers as those of the money reception unit 10 shown in FIG. 1, and redundant description will be omitted.

The "back-receipt type" of money reception unit 80 is provided with a money receipt box 81 at the back side of an ATM as well as the money receipt box 11 at the front side of the ATM. An ATM having such a "back-receipt type" of money reception unit 80 is established, for example, at a retail store which cooperates with a financial institution. The front of the ATM is utilized by the customers of the ATM and the back of the ATM is utilized by the retail store for the purpose of receipt of takings.

A performance of the "back-receipt type" of money reception unit 80 is divided broadly into five categories of the receipt operation from the front, the receipt operation from the back, the transfer operation, the return operation to the front, and the return operation to the back. Of these operations, the receipt operation from the front, the transfer operation, and the return operation to the front are completely the same as those of the money reception unit 10. And thus the redundant description will be omitted.

Hereinafter, there will be described the receipt operation from the back.

The money reception unit 80 is provided with conveyance passages 82*a* and 82*b* for conveying paper moneys, a distribution gate 83 for distributing paper moneys to the conveyance passage 82*b* or the conveyance passage 12*c*, and a return box 84. A paper money supplied to the money receipt box 81 is received through the conveyance passage 82*a* into the ATM and is conveyed. Accordingly, the money receipt box 81 and the conveyance passage 82*a* constitute an example of the receipt mechanism referred to in the present invention. Paper moneys received into the ATM are conveyed through the conveyance passage 82*a* to the receipt discriminator 14 so as to be discriminated. When the receipt discriminator 14 discriminates a paper money as a "counterfeit note", the paper money after the discrimination is distributed to the conveyance passage 82*b* by the distribution gate 83 and is stored in the return box 84. When the receipt discriminator 14 discriminates a paper money as a "true note", the paper money after the discrimination is distributed to the conveyance passage 12*c* by the distribution gate 83. And the paper money is distributed to the conveyance passage 12*d* by the distribution gate 15*a*, and is conveyed through the conveyance passage 12*d* to the distribution gate 15*b*, and further is distributed to the conveyance passage 12*e* by the distribution gate 15*b*. Paper moneys distributed to the conveyance passage 12*e* by the distribution gate 15*b* are conveyed in such a manner that the one-way gate 13*b* is pushed aside, and then are stored in the temporal shed 16.

In the return operation, paper moneys stored in the temporal shed 16 are conveyed through the conveyance passage 12*f* and 12*b*, passing through the receipt discriminator 14, to the conveyance passage 82*b* by the distribution gate 83 so as to be stored in the return box 84.

Incidentally, according to the present embodiments, the control unit is provided within the payment unit. It is acceptable that the control unit referred to in the present invention is provided independently of the receipt unit and the delivery unit. Alternatively, it is also acceptable that the control unit is divided to two parts one of which is provided in the receipt unit and another is provided in the delivery unit.

As mentioned above, according to a paper processing apparatus of the present invention, it is possible to reduce the cost required for a development of the apparatus.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A paper processing unit comprising;

a delivery unit comprising a shed for receiving paper moneys, a delivery mechanism for delivering paper moneys from said shed to an exterior, and a first paper discriminator for discriminating paper moneys to be delivered by said delivery mechanism to the exterior;

a receipt unit coupled to said delivery unit comprising a receipt mechanism for receiving paper moneys inserted from the exterior, a second paper discriminator for discriminating the paper moneys received by said receipt mechanism, a conveyance mechanism for conveying the paper moneys discriminated by said second paper discriminator to said delivery unit, and a signal generator which outputs a signal identifying a type of said receipt unit coupled to said delivery unit;

a control unit receiving signal from said generator identifying the type of said receipt unit coupled to said delivery unit, said controlling said delivery unit and said receipt unit, wherein said delivery unit is detachably coupled to any of a plurality of said types of said receipt unit, and wherein said control unit performs control of receipt operation according to said type of receipt unit coupled to said delivery unit.

2. A paper processing apparatus according to claim 1, wherein said delivery unit includes a backflow preventer for preventing paper moneys from flowing backward from said delivery unit to said receipt unit.

3. A paper processing apparatus according to claim 1, wherein said receipt unit includes a temporal shed for temporarily receiving the paper moneys discriminated by said second paper discriminator, and wherein said conveyance mechanism conveys the paper moneys received in said temporal shed to said delivery unit.

* * * * *